US006820681B2

(12) United States Patent
Ohgami et al.

(10) Patent No.: US 6,820,681 B2
(45) Date of Patent: Nov. 23, 2004

(54) HEATING REGENERATION TYPE ORGANIC ROTOR MEMBER AND METHOD FOR PRODUCING THE SAME

(75) Inventors: Katsushi Ohgami, Tokyo (JP); Takehiko Ajima, Tokyo (JP)

(73) Assignee: Mitsubishi Paper Mills Limited, Tokyo (JP)

( * ) Notice: Subject to any disclaimer, the term of this patent is extended or adjusted under 35 U.S.C. 154(b) by 43 days.

(21) Appl. No.: 09/968,612

(22) Filed: Oct. 2, 2001

(65) Prior Publication Data

US 2002/0070002 A1 Jun. 13, 2002

(30) Foreign Application Priority Data

| | | |
|---|---|---|
| Oct. 5, 2000 | (JP) | 2000-306114 |
| Oct. 6, 2000 | (JP) | 2000-307455 |
| Nov. 10, 2000 | (JP) | 2000-342914 |
| Dec. 5, 2000 | (JP) | 2000-369916 |
| May 23, 2001 | (JP) | 2001-153430 |
| Sep. 20, 2001 | (JP) | 2001-286382 |

(51) Int. Cl.[7] ..... F28D 19/00
(52) U.S. Cl. ..... 165/10; 165/4; 165/8
(58) Field of Search ..... 165/8, 10, 4

(56) References Cited

U.S. PATENT DOCUMENTS

| | | | | |
|---|---|---|---|---|
| 4,182,402 A | * | 1/1980 | Adrian | 165/10 |
| 4,235,608 A | * | 11/1980 | Watanabe et al. | 96/118 |
| 4,402,717 A | * | 9/1983 | Izumo et al. | 55/388 |
| 4,513,807 A | * | 4/1985 | Rose et al. | 165/10 |
| 4,886,769 A | * | 12/1989 | Kuma et al. | 502/62 |
| 5,120,597 A | * | 6/1992 | Takimoto et al. | 428/246 |
| 5,435,981 A | * | 7/1995 | Ichiki et al. | 423/239.1 |
| 5,440,899 A | * | 8/1995 | De Beijer et al. | 62/480 |
| 5,503,222 A | * | 4/1996 | Dunne | 165/104.12 |
| 5,512,083 A | * | 4/1996 | Dunne | 95/113 |
| 5,664,620 A | * | 9/1997 | Ritter | 165/8 |
| 5,667,560 A | * | 9/1997 | Dunne | 95/113 |
| 5,685,897 A | * | 11/1997 | Belding et al. | 96/154 |
| 5,701,762 A | * | 12/1997 | Akamatsu et al. | 62/636 |
| 5,740,856 A | * | 4/1998 | Ritter | 165/10 |
| 5,771,707 A | * | 6/1998 | Lagace et al. | 62/271 |
| 6,328,787 B1 | * | 12/2001 | Yamauchi | 95/113 |
| 6,675,871 B2 | * | 1/2004 | Okano et al. | 165/8 |

FOREIGN PATENT DOCUMENTS

| | | | |
|---|---|---|---|
| JP | 54019548 | 2/1979 | |
| JP | 63078739 | * 4/1988 | B32B/3/12 |
| JP | 710330 | 10/1988 | |
| JP | 5115737 | 5/1993 | |
| JP | 6226037 | 8/1994 | |

* cited by examiner

*Primary Examiner*—Henry Bennett
*Assistant Examiner*—Nihir Patel
(74) *Attorney, Agent, or Firm*—Paul E. White, Jr.; Manelli Denison & Selter PLLC

(57) ABSTRACT

The object of the present invention is to provide a heating regeneration type organic rotor member which comprises a honeycomb structural body capable of being continuously regenerated by heating upon rotational driving and remarkably improved in mechanical strength by using a fiber substrate essentially composed of organic fibers and which can efficiently adsorb and remove moisture and odor components in the air by the action of moisture adsorbent and active carbon carried on the fiber substrate, and to provide a method for producing the same. According to the present invention, there is provided a heating regeneration type organic rotor member which is produced by forming a functional substrate into a honeycomb structural body, the functional substrate comprising a fiber substrate containing organic fibers as an essential component and carrying thereon a moisture adsorbent and an active carbon.

6 Claims, 2 Drawing Sheets

HEATING REGENERATION TYPE ORGANIC ROTOR MEMBER AND METHOD FOR PRODUCING THE SAME

BACKGROUND OF THE INVENTION

The present invention relates to a heating regeneration type organic rotor member which is a honeycomb structural body capable of being continuously regenerated by heating with rotational driving and highly increased in mechanical strength by using a fiber substrate comprising organic fibers as an essential component and, furthermore, capable of efficiently adsorbing and removing simultaneously the moisture and odor components in the air by the action of moisture adsorbent and active carbon carried on the fiber substrate, and a method for producing the same.

There have been proposed various rotor members which can be continuously regenerated by heating with rotational driving and have dehumidification function or deodorizing function. The rotor members will be explained below referring to dehumidification as an example. FIG. 1 schematically shows a typical dehumidification rotor member. A cylindrical honeycomb structural body carrying a moisture adsorbent such as zeolite, active alumina, silica gel, lithium chloride, or calcium chloride is provided around a core material 1 in such a manner that the opening face of the structural body forms a cylindrical section, thereby to obtain a dehumidification rotor member 2. The dehumidification rotor member 2 is rotated in the direction of arrow 3 with the core material 1 as a central axis, and water contained in air 4 which is to be dried is adsorbed and removed by the action of the moisture adsorbent while the air 4 passes through the dehumidification rotor member 2, thereby obtaining a dry air 5. Regenerating air 6 which regenerates the dehumidification rotor member 2 is heated by a heat source 7 and is converted to hot air 8, which removes water from the dehumidification rotor member 2, whereby the dehumidification rotor member 2 is regenerated and simultaneously a high humidity air 9 containing water is obtained. The thus obtained dry air 5 and high humidity air 9 are supplied to a given space depending on the purpose of use. The deodorization rotor member is also the same as the dehumidification rotor member in basic conception, and odor components are adsorbed and removed using a cylindrical honeycomb structural body carrying an adsorbent such as active carbon.

Temperature of the high-temperature air which regenerates the rotor member is about 150–200° C., and hence the rotor member is required to have a high heat resistance. Furthermore, since the heat source is provided nearby, the rotor member must additionally have a high flame retardance. Therefore, hitherto, inorganic materials having high heat resistance and non-combustibility have been used for rotor members. For example, JP-A-54-19548 proposes a rotating regeneration type dehumidification material obtained by coating a mixed solution prepared by adding kaolin, colloidal silica and an organic resin emulsion to a molecular sieve as a moisture adsorbent on a support such as a wire net, a metallic foil, a glass fiber sheet or an asbestos paper, and drying the coat, and, furthermore, impregnating the coated support with ethyl silicate and hardening it by hydrolysis, followed by heating at 250° C. or higher to burn and remove the organic resin emulsion. As for continuous and dry type dehumidifiers to be regenerated by heating, JP-A-63-240921 proposes a dehumidification member obtained by adding an inorganic binder such as colloidal silica, colloidal alumina, colloidal titanium, metal alkoxide, bentonite or sepiolite to zeolite as a moisture adsorbent, followed by mixing them, extrusion molding the resulting mixture to a honeycomb structure, and then firing the molded product at about 800° C. JP-A-6-226037 proposes a honeycomb-shaped adsorption rotor obtained by forming an inorganic fiber paper made with addition of a small amount of pulp and binder to silica-alumina ceramics fibers into a honeycomb structure, laminating and adhering the honeycomb-shaped body into a cylindrical form, firing the honeycomb-shaped cylindrical body at high temperatures to remove organic materials, impregnating the honeycomb cylindrical body with a sol prepared by mixing zeolite as a moisture adsorbent with an aqueous sol of silica or alumina as an inorganic binder, and drying the honeycomb cylindrical body at high temperatures. JP-A-5-115737 proposes a honeycomb adsorption rotor obtained by impregnating a honeycomb formed body mainly composed of ceramic fibers with an active silica gel or an active metal silicate gel having both the moisture adsorptivity and the odor adsorptivity and bonding the gel to the honeycomb formed body.

The above rotor members are incombustible members composed of only inorganic materials and having a high heat resistance, and they function effectively as rotor members which are continuously regenerated by heating upon rotational driving. However, considering the application of them to domestic appliances, for some uses (for example, domestic deodorization or dehumidification), regeneration at high temperatures is not necessarily needed or regeneration systems at high temperatures can hardly be employed from the viewpoints of heat resistance of casings of appliance, saving of energy and safety, and for these reasons, such heat resistance and incombustibility as of inorganic type rotor members are not essential for the application to appliances. Rather, the following problems of the inorganic type rotor members are present and solution of them is demanded. (1) They are hard and brittle like pottery, and hence very weak against shock and readily broken; (2) Since high-temperature heat treatment such as firing is carried out for the removal or diminishment of organic components, there are possibilities of deterioration in adsorption characteristics of moisture adsorbents or adsorbing agents or restrictions in selection of raw materials; (3) Fixation strength of moisture adsorbents or adsorbents are insufficient in the case of using only inorganic materials, and exfoliation of them to some extent cannot be avoided; (4) It is difficult to control thickness of the substrate constituting the rotor members or to make thin the substrate, and it is difficult to control and decrease the pressure loss of the rotor members; and (5) Since the method of production is like production of ceramics, change of volume is apt to occur in rotor members at the time of high-temperature heat treatments such as firing to cause reduction in accuracy of size or breakage, resulting in reduction of yield, and thus they become expensive.

SUMMARY OF THE INVENTION

The object of the present invention is to provide a heating regeneration type organic rotor member capable of efficiently adsorb and remove moisture and odor components which is a honeycomb structural body capable of being continuously regenerated by heating with rotational driving, and a method for producing the same.

As a result of intensive research conducted by the inventors in an attempt to solve the above problems, the following heating regeneration type organic rotor member and method for producing the same have been accomplished.

1. A heating regeneration type organic rotor member continuously regenerated by heating with rotational driving which is produced by forming a functional substrate into a honeycomb structural body, the functional substrate comprising a fiber substrate containing organic fibers as an essential component and carrying thereon a moisture adsorbent and an active carbon.

2. A heating regeneration type organic rotor member of the above 1, wherein the moisture adsorbent is at least one member selected from the group consisting of zeolite, silica gel, allophane and sepiolite.

3. A heating regeneration type organic rotor member of the above 1 or 2, wherein the organic fibers are heat resistant organic fibers.

4. A heating regeneration type organic rotor member of the above 3, wherein the heat resistant organic fibers are at least one member selected from the group consisting of wholly aromatic polyamide fibers, wholly aromatic polyester fibers and phenolic resin fibers.

5. A heating regeneration type organic rotor member of any one of the above 1–4, wherein the functional substrate comprises a fiber substrate carrying thereon an agglomeration composite of a moisture adsorbent, an active carbon and organic fibers fibrillated to a freeness of not less than 30 seconds.

6. A heating regeneration type organic rotor member of any one of the above 1–5, wherein the fiber substrate contains inorganic fibers.

7. A method for producing a heating regeneration type organic rotor member which comprises adding fibers containing organic fibers as an essential component, a moisture adsorbent and an active carbon to water and mixing them to prepare a slurry, making a web using the slurry by a wet paper making process, subjecting the web to a pressing and heating treatment to produce a functional substrate, and forming the functional substrate into a honeycomb structural body.

8. A method for producing a heating regeneration type organic rotor member which comprises impregnating or coating a fiber substrate with a dispersion containing a moisture adsorbent and an active carbon to produce a functional substrate, and forming the functional substrate into a honeycomb structural body, wherein the fiber substrate contains organic fibers as an essential component.

DETAILED DESCRIPTION OF THE INVENTION

Figure 1:
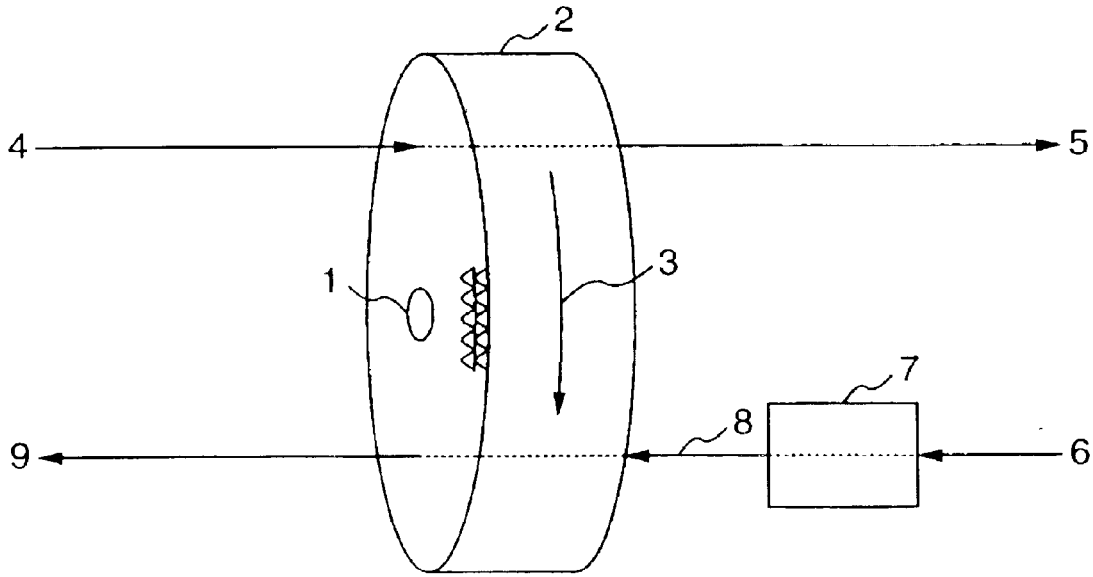
FIG. 1 schematically illustrates a typical dehumidification rotor member.

The constitutive elements of the heating regeneration type organic rotor member of the present invention will be explained in detail below.

First, the functional substrate which is a substrate of the heating regeneration type organic rotor member of the present invention will be explained.

The functional substrate of the present invention comprises a fiber substrate essentially composed of organic fibers and carrying thereon a moisture adsorbent and an active carbon.

As the organic fibers as an essential component of the fiber substrate of the present invention, there may be used known organic fibers, e.g., organic synthetic fibers such as polyamide fibers, polyester fibers, polyurethane fibers, polyvinyl alcohol fibers, polyvinylidene chloride fibers, polyvinyl chloride fibers, polyacrylonitrile fibers, polyolefin fibers and rayon fibers, and organic natural fibers such as wood pulp, hemp pulp and cotton linter pulp. These may be used each alone or in combination of two or more.

Organic fibers high in flexibility are very strong against shock, and the heating regeneration type organic rotor member of the present invention using as a substrate a functional substrate containing organic fibers as an essential component is a member excellent in mechanical strength and having high shock resistance. Furthermore, since the organic fibers are sufficiently interlocked to form a uniform and strong network fiber substrate, not only the rotor member is excellent in retention ability for moisture adsorbent and active carbon, but also high-temperature heat treatments such as firing for formation which are essential for conventional inorganic rotor members are not needed and thus deterioration of adsorption characteristics of moisture adsorbent and active carbon caused by the above treatments, restriction in selection of raw materials and variation in size accuracy of the rotor member can be avoided. Moreover, organic fibers have various fiber shapes, fiber diameters and fiber lengths, and not only the thickness of the functional substrate can be optionally adjusted according to combinations of them, but also since the functional substrate per se can be optionally adjusted in its thickness with high accuracy by pressing treatment or the like, control of pressure loss of the rotor member which has been difficult for the conventional inorganic rotor members can be easily performed.

Amount of the organic fibers added is preferably not less than 50% based on the weight of the fiber substrate. If the amount is less than 50% , the organic fibers is insufficient in the amount and the above effects caused by the use of the organic fibers cannot be sufficiently exhibited.

For the purpose of improving heat resistance and flame retardance of the heating regeneration type organic rotor member of the present invention, heat resistant organic fibers can be preferably used as the organic fibers. The heat resistant organic fibers are required to have a molecular structure of high intermolecular bond energy in which hydrogen bond or atomic group of high intermolecular force is introduced, a stiff molecular structure in which an aromatic ring or a heterocyclic ring is introduced, a molecular structure high in symmetry, a three-dimensional network molecular structure, or the like. As fibers having these molecular structures, mention may be made of wholly aromatic polyamide fibers, wholly aromatic polyester fibers, phenolic resin fibers, poly-p-phenylenebenzobisthiazole fibers, poly-p-phenylenebenzobisoxazole fibers, polybenzimidazole fibers, polyether imide fibers, fluorocarbon fibers, and the like. These fibers can be used each alone or in combination of two or more. Among them, wholly aromatic polyamide fibers, wholly aromatic polyester fibers and phenolic resin fibers are especially preferred, taking into consideration the workability of them into the functional substrate and the heating regeneration type organic rotor member mentioned hereinafter.

Since the heat resistant organic fibers have excellent heat resistance and high flame retardance, and can markedly increase the heat resistance and the flame retardance of the heating regeneration type organic rotor member of the present invention, there can be obtained an organic rotor member which can stand heating regeneration in a high-temperature atmosphere as in the case of the inorganic rotor members. Moreover, the heat resistant organic fibers are also excellent in shock resistance and can further improve the mechanical strength of the heating regeneration type organic rotor member of the present invention.

Amount of the fiber substrate is preferably 20–70% , more preferably 30–50% based on the weight of the functional substrate. If the amount is less than 20% , the amount of the fiber substrate is insufficient, and not only the moisture adsorbent and active carbon readily falls off, but also the resulting functional substrate is poor in flexibility and brittle. On the other hand, if it is more than 70% , amounts of the moisture adsorbent and the active carbon become insufficient and sufficient adsorbing performance cannot be obtained.

The shape of the fiber substrate is not particularly limited, but it is preferred that the substrate is high in gas permeability to increase contact efficiency with moisture and odor component and has flexibility to make easy the working into the heating regeneration type organic rotor member. Fiber substrate in the form of nonwoven fabric is especially preferred because it gives these characteristics.

As to the form of the organic fibers, an optimum form may be selected depending on the method of production of the fiber substrate. Details of the production method will be explained hereinafter, but in the case of a wet method, the fineness is preferably about 0.1–15 deniers and the fiber length is preferably about 1–20 mm, and chopped fibers, fibrillated pulp and the like can be used in optional combination. In the case of a dry method with use of cards, the fineness is preferably about 1–30 deniers and the fiber length is preferably about 40–80 mm.

As far as the effects attained by the use of the organic fibers are not damaged, inorganic fibers may be used in combination with the organic fibers for further improvement of heat resistance and flame retardance of the heating regeneration type organic rotor member of the present invention. As the inorganic fibers, there may be optionally used glass fibers, carbon fibers, metallic fibers, ceramic fibers, rock wool, and the like. Amount of the inorganic fibers is preferably at most 50% based on the weight of the fiber substrate.

Next, moisture adsorbent will be explained below.

The moisture adsorbent used in the present invention has a function to adsorb and remove moisture in the air, and known moisture adsorbents, such as zeolite, silica gel, allophane, sepiolite, active alumina, lithium chloride, calcium chloride and the like, can be used widely. Among them, zeolite, silica gel, allophane and sepiolite are especially preferred because not only they are superior in moisture adsorbing performance, but also they are not deliquescent as lithium chloride and calcium chloride are.

First, zeolite will be explained.

Zeolites used in the present invention include both the natural zeolites and synthetic zeolites, and any of them can be used each alone or in combination of two or more. Zeolites have the feature of rapid adsorption of water since they adsorb water by taking water into pores in the molecules.

More than 30 kinds of natural zeolites are known. Representatives thereof are analcite, chabazite, clinoptilolite, erionite, ferrierite, mordenite, laumonite, and phillipsite, and among them, analcite, clinoptilolite and mordenite are high in yield and generally used. On the other hand, synthetic zeolites include A-type zeolite, X-type zeolite, Y-type zeolite, and the like. The pore diameter of zeolites has no special limitation, but taking into consideration the fact that diameter of water molecule is 2.8 angstroms, those which have a pore diameter of about 3–4 angstroms are especially preferred because they are hardly affected by co-adsorption of coexisting gas and can selectively adsorb and remove only the moisture in the air.

Next, silica gel will be explained.

Silica gel used in the present invention is a high density three-dimensional agglomerate of colloidal silica fine particles and is a porous body of amorphous silicon dioxide. The surface silanol groups of silica gel are polar groups which are apt to produce hydrogen bonds with other molecules and selectively adsorb polar molecules represented by water molecules.

Next, allophane will be explained.

Allophane used in the present invention is a non-crystalline or low-crystalline hydrous aluminum silicate having a molar ratio $SiO_2/Al_2O_3$ of 1.0–2.0 and is an aggregate of hollow spherical fine particles having a diameter of 35–50 angstroms. The sphere wall of allophane has defects through which water molecules can enter and leave.

Next, sepiolite will be explained.

Sepiolite used in the present invention is a hydrous magnesium silicate, has a very high wettability with water and has a property of adsorbing and retaining water in an amount of as much as 100–120% of its own weight.

As mentioned above, zeolite, silica gel, allophane and sepiolite are all excellent in performance to adsorb and remove moisture and highly effectively function as moisture absorbents of the heating regeneration type organic rotor member of the present invention. Zeolite has a moisture adsorption amount of high capacity under low to medium humidity conditions, and silica gel, allophane and sepiolite have a moisture adsorption amount of high capacity under high humidity conditions. Thus, by using zeolite, silica gel, allophane and sepiolite in suitable combination, dehumidification performance can be adjusted to a desired range over a wide humidity area of low humidity to high humidity. Therefore, ratio of the amount of zeolite, silica gel, allophane and sepiolite in the moisture adsorbent is not particularly limited, and can be suitably selected depending on the desired dehumidification performance.

Next, active carbon will be explained below.

Active carbon used in the present invention is used not only for adding a new function such as deodorization performance by adsorbing and removing gases other than moisture in the air, such as odor components, but also for inhibiting the deterioration of moisture adsorption performance of the moisture adsorbent which is caused by co-adsorption of gases other than moisture.

As the active carbon, there may be widely used known active carbons prepared by gas activation or chemical activation of vegetable precursors such as wood chip, sawdust, pure ash, charcoal and fruit shell, mineral precursors such as coal, tar, coal pitch, coal coke and petroleum pitch, synthetic precursors such as phenolic resin, acrylic resin and vinylidene chloride resin, natural precursors such as rayon, marine algae and grain.

Active carbons contain metal oxides such as silica, alumina, oxides of alkali metals, alkaline earth metals and iron as impurities, and the surface thereof has polarity, but it is very small. Thus, active carbons are known as hydrophobic adsorbents. Therefore, adsorbability for moisture is weak and can selectively adsorb and remove gases other than moisture present in the air. Moreover, since active carbons adsorb and remove most of the gases by physical adsorbing action, the adsorption performance can be easily regenerated.

Therefore, by using active carbon in combination with moisture adsorbent, not only a new function such as deodorization can be added, but also since active carbon selectively adsorbs and removes co-existing gases other than moisture, the moisture adsorbent can selectively and efficiently adsorb moisture even under the conditions of various co-existing gases being present.

Furthermore, even the hydrophobic adsorbent such as active carbon unavoidably adsorbs moisture to some extent, but since the moisture adsorbent selectively adsorb moisture, adsorption effect of active carbon can also be enhanced. That is, use of moisture adsorbent and active carbon in combination synergistically enhances the adsorption performance of both the moisture adsorbent and active carbon.

Further surprisingly, it has been found that there is obtained an unexpected effect that regeneration efficiency of moisture adsorption performance by the heating regeneration of the heating regeneration type organic rotor member is improved by the use of moisture adsorbent and active carbon in combination. The mechanism of development of such effect is not clear, but it can be considered that the presence of hydrophobic active carbon as a carrier in the moisture adsorbent effectively secures the way of escape for the moisture released from the moisture adsorbent.

Total amount of the moisture adsorbent and the active carbon is preferably 30–80% , more preferably 50–70% based on the weight of the functional substrate. If the total amount is less than 30% , amounts of the moisture adsorbent and the active carbon are insufficient, and sufficient adsorption performance cannot be obtained. If it is more than 80% , amount of the fiber substrate is insufficient, and not only the moisture adsorbent and the active carbon are apt to fall-off, but also the resulting functional substrate is poor in flexibility and is fragile.

Ratio of the amounts of the moisture adsorbent and the active carbon is not particularly limited and can be optionally selected depending on the desired adsorption performance. However, in order to obtain the effect of using moisture adsorbent and active carbon in combination, it is preferred that amount of the active carbon (or the moisture adsorbent) is not less than 10 parts by weight based on 100 parts by weight of the moisture adsorbent (or the active carbon). Furthermore, the carrying amount of the moisture adsorbent and the active carbon in total has no special limitation, but is preferably not less than 30 $g/m^2$, more preferably not less than 50 $g/m^2$ for obtaining satisfactory adsorption characteristics.

Fixation strength of the moisture adsorbent and the active carbon can be further enhanced by carrying the moisture adsorbent and the active carbon on the fiber substrate through highly fibrillated organic fibers. An example of the method for obtaining such carrying state is to form an agglomeration composite of the moisture adsorbent, the active carbon and the highly fibrillated organic fibers.

The highly fibrillated organic fibers used in the present invention are organic fibers fibrillated to a freeness of not less than 30 seconds (hereinafter referred to as "fibrillated organic fiber"), and the diameter of the fibrils constituting the fibrillated organic fibers is very small. Therefore, specific surface area of the fibrillated organic fibers is very large, and, thus, not only much moisture adsorbent and active carbon can be retained on the surface, but also since the fibrillated organic fibers sufficiently interlock with each other, the agglomeration composite containing the fibrillated organic fibers has a very high strength. Furthermore, the fibrillated organic fibers also sufficiently interlock with the fiber substrate and contribute to the formation of a uniform network of the fiber substrate, whereby the moisture adsorbent and the active carbon can be uniformly and firmly retained in the fiber substrate.

Further surprisingly, it has been found that there is obtained an unexpected effect that both the characteristics of dehumidification and deodorization are improved by using the fibrillated organic fibers. The mechanism of development of such effect is not known, but the following can be considered. (1) By forming the agglomeration composite, the moisture adsorbent and the active carbon are in close vicinity to each other, and the synergistic effects caused by the use of moisture adsorbent and active carbon in combination are further enhanced, and (2) the fibrillated organic fibers are satisfactorily present between the moisture adsorbents, between the active carbons, and between the moisture adsorbent and the active carbon to produce proper clearance, which has good influence on adsorption and desorption of moisture or odor components.

The "freeness" employed in the present invention is a value measured by the method disclosed in JP-B-2-60799. This method can be applied to a slurry having too low freeness, which cannot be measured in the pulp freeness testing method (Canadian standard) specified in JIS-P-8121.

Specifically, the freeness is measured according to the following procedure.

An aqueous dispersion (20% ) containing 0.3% by weight of fibrillated organic fibers is prepared, and 1 liter of this dispersion is taken. This aqueous dispersion is put in a cylindrical vessel having an inner diameter of 102 mm (having a metal gauze of 78 mesh at the bottom), and a time (second) required for obtaining 500 ml of a filtrate from the bottom of the cylindrical vessel is measured and is taken as the freeness.

Examples of the methods for obtaining fibrillated organic fibers are as follows.

(1) A method which comprises pouring a synthetic polymer solution in a poor solvent for the polymer under application of shearing force to precipitate fibrous fibrils (fibrid method, JP-B-35-11851).

(2) A method which comprises applying shearing force to a synthetic monomer under being polymerized (polymerization shearing method, JP-B-47-21898).

(3) A method which comprises mixing two or more incompatible polymers, melt extruding or spinning the mixture, cutting the product, and fibrillating into the form of fibers by a mechanical means (split method, JP-B-35-9651).

(4) A method which comprises mixing two or more incompatible polymers, melt extruding or spinning the mixture, cutting the product, immersing the product in a solvent to dissolve one of the polymers and fibrillating into the form of fibers (polymer blend dissolution method, U.S. Pat. No. 3,382,305).

(5) A method which comprises explosively discharging a synthetic polymer at higher than the boiling point thereof from the higher pressure side to the lower pressure side, and then fibrillating the polymer into the form of fibers (flash spinning method, JP-B-36-16460).

(6) A method which comprises blending a polyester polymer with an alkali-soluble component incompatible with the polyester, molding the blend, then beating the product with an alkali to reduce the weight, and fibrillating the polymer into the form of fibers (alkali weight loss beating method, JP-B-56-315).

(7) A method which comprises cutting high crystalline and high orientation fibers such as cellulose fibers or Kepler fibers to a suitable fiber length, dispersing the fibers in water, and fibrillating the fibers by a homogenizer or beating machine (JP-A-56-100801).

Amount of the fibrillated organic fibers is preferably 5–50% , more preferably 10–30% based on the total weight of the moisture adsorbent and the active carbon. If the amount is less than 5% by weight, further improvement of synergistic effects brought about by the use of the moisture adsorbent and the active carbon in combination, retention ability for the moisture adsorbent and the active carbon, and ability of forming network of the fiber substrate are insufficient. On the other hand, if it is more than 50% , the agglomeration composite and the network of the fiber substrate become dense, resulting in reduction of contact efficiency between moisture adsorbent or active carbon and air.

Next, method for producing the functional substrate of the present invention will be explained below.

As the method for the production of the functional substrate, mention may be made of, for example, a method of allowing the moisture adsorbent and the active carbon to be carried on the fiber substrate using a wet method, and a method of impregnating or coating the fiber substrate prepared by a wet method or a dry method with a dispersion of moisture adsorbent and active carbon.

First, the production method of allowing the moisture adsorbent and the active carbon to be carried on the fiber substrate using a wet method will be explained.

Fibers comprising organic fibers as essential component, moisture adsorbent and active carbon are added to water and mixed to prepare a slurry. For attaining uniform dispersion in water, solid concentration of the slurry is preferably 0.1–5% by weight. Webs are formed from the slurry using paper making machines for making general papers or wet nonwoven fabrics, such as Fourdrinier paper machine, cylinder paper machine, tilting wire type paper machine, and the like.

When fibrillated organic fibers are used, an agglomeration composite of the moisture adsorbent, the active carbon and the fibrillated organic fibers is previously formed using a suitable agglomerating agent, and the resulting agglomeration composite and fibers containing organic fibers as an essential component are added and mixed with water to prepare a slurry. Of course, even in the case of using no fibrillated organic fibers, an agglomerate of moisture adsorbent and active carbon may also be formed for improving yield and fixation strength of the moisture adsorbent and the active carbon in the fiber substrate.

As the agglomerating agent, there may be used, for example, cationic polymer agglomerating agents such as cationic polyacrylamide and polyaluminum chloride. Furthermore, it is also possible to use anionic polymer agglomerating agents which form composites with the above cationic polymer agglomerating agents to strengthen the agglomeration, such as anionic polyacrylamide, anionic inorganic fine particles, e.g., colloidal silica and bentonite aqueous dispersion.

One of the resulting webs or a laminate of two or more of the webs is subjected to a pressing and heating treatment by a cylinder drier, a Yankee drier or the like to dry the webs, thereby producing the functional substrate of the present invention. Furthermore, naturally, the functional substrate may be subjected to a pressing and heating treatment using a hot press or hot calender for the purpose of densification of the functional substrate in order to further increase the strength of the functional substrate or reduce the pressure loss of the heating regeneration type organic rotor member of the present invention.

Next, the method of impregnating or coating a fiber substrate prepared by a wet method or a dry method with a dispersion of moisture adsorbent and active carbon to carry them on the substrate will be explained.

As methods for producing the fiber substrate, mention may be made of the above-mentioned wet method and additionally known dry methods such as chemical bonding method, thermal bonding method, melt blowing method, spun bonding method, needle punching method, and water jet entangling method, and the substrate is produced using a group of fibers constituting the fiber substrate containing organic fibers as essential component.

Moisture adsorbent and active carbon are dispersed in water (this may be the above-mentioned agglomeration composite), and to the dispersion is added a binder component such as a thermoplastic polymer emulsion, a metal oxide composite thermoplastic polymer emulsion or a film forming inorganic material to prepare a dispersion. Then, the fiber substrate is impregnated or coated with the dispersion by various coating apparatuses such as blade coater, roll coater, air knife coater, bar coater, rod blade coater, short dowel coater, comma coater, die coater, reverse coater, kiss-roll coater, dip coater, curtain coater, extrusion coater, gravure coater, micro gravure coater, and size press, thereby producing the functional substrate of the present invention. For the same purpose as mentioned above, the functional substrate may be subjected to a pressing and heating treatment using hot press, hot calender or the like.

The thermoplastic polymer emulsion here means a thermoplastic polymer dispersed in water, and examples of the polymer component are acrylic-resin, styrene-acrylic copolymer, styrene-butadiene copolymer, ethylene-vinyl acetate copolymer, vinyl chloride-vinyl acetate copolymer, ethylene-vinyl acetate-vinyl chloride copolymer, polypropylene, polyester, phenoxy resin, phenolic resin and butyral resin.

The film forming inorganic material here includes, for example, natural clay minerals, e.g., smectites group such as saponite, hectorite and montmorillonite, vermiculite group, kaolinite-serpentine group such as kaolinite and halloysite, and, besides, colloidal silica, colloidal alumina and modification products of them, and synthetic inorganic polymer compounds.

The term "modification" in the "modification product" means that the characteristics peculiar to natural minerals are extended or new characteristics are imparted to the natural minerals by removing impurities or specific atomic groups from natural minerals, by treating a specific element of constitutive elements of natural minerals by a suitable process to replace the element with another element, or by subjecting the minerals together with other compounds (particularly, organic compounds) to a chemical treatment to change especially the surface properties of the minerals. Examples of the modification products are Na-montmorillonite obtained by treating Ca-montmorillonite with sodium carbonate or the like in the presence of water to perform ion exchanging, and those obtained by subjecting to a treatment with cationic surface active agents and/or nonionic surface active agents.

The synthetic inorganic polymer compound in the present invention is one which is obtained by replacing a specific element of the same composition with other element in order to obtain the same composition as of natural minerals or impart new characteristics, and is obtained by reacting two or more compounds. Examples thereof are synthetic smectites and fluoro-micas obtained by replacing hydroxyl group in the structure of natural mica group with fluorine. Typical examples of the fluoro-micas are fluoro-phlogopite, fluoro-tetrasilicic mica and taeniolite.

The metal oxide composite thermoplastic polymer emulsions in the present invention are those which comprise the above-mentioned thermoplastic polymer emulsions, the surface of which is covered with a metal oxide and which have such characteristics as maintaining a sea-islands structure upon separation of the polymer component and the metal oxide component even after the formation of a film.

Examples of the metal oxide are colloidal silica, colloidal alumina, and the like. As disclosed in JP-A-59-71316 and JP-A-60-127371, for example, colloidal silica composite thermoplastic polymer emulsion can be obtained by fixing a silica component on the surface of emulsion in the course of preparing a polymer component by mixing a copolymerizable monomer, a monomer having in the molecule a polymerizable unsaturated double bond and alkoxysilane group, vinylsilane and colloidal silica and then emulsion polymerizing the mixture. As disclosed in International Symposium on Polymeric Microspheres Prints, 1991, 181, the above method includes, for example, a method of precipitating and fixing a silica component on the surface of a previously formed emulsion using a hydrolyzable alkoxysilane which is incompatible with water, such as ethyl orthosilicate.

In the case of conventional inorganic rotor members, high-temperature heat treatments such as firing are essential for impartment of strength or removal or reduction of organic components, and deterioration of adsorption performance caused by the above treatments cannot be avoided and a large amount of moisture adsorbent or active carbon must be used for obtaining the desired adsorbent performance. Moreover, since active carbon burns at a normal firing temperature, it must be carried on the rotor members after drying at low-temperatures using inorganic binders, and it is difficult to firmly fix it on the rotor members. However, in the case of the functional substrate produced by the method of the present invention, the moisture adsorbent and the active carbon can be firmly carried on the fiber substrate, and thus the above problems can be solved. Furthermore, since reduction of the thickness or control of thickness of the substrate which has been difficult in the case of the conventional inorganic rotor members can be easily performed, the pressure loss of the rotor members can be adjusted to the desired level.

Next, the heating regeneration type organic rotor member of the present invention will be explained below.

The heating regeneration type organic rotor member of the present invention is characterized by comprising a functional substrate which is formed into a honeycomb structural body. The honeycomb structural body in the present invention is a structural body which comprises cell walls having openings. As examples thereof, mention may be made of a corrugated honeycomb structural body comprising a single faced corrugated fiberboard made in accordance with "corrugated fiberboard for outer packaging" specified in JIS-Z-1516-1995, a hexagon honeycomb structural body comprising hexagonal cells, a honeycomb structural body comprising square cells, a hexagon honeycomb structural body comprising triangular cells, and a honeycomb structural body comprising an aggregate of hollow cylindrical cells. Here, the shape of cells such as hexagon or square must not necessarily be a regular polygon, and may be irregular shape, for example, the angles may be roundish or the sides may be curved.

As the method for producing the heating regeneration type organic rotor member of the present invention, there are a method of cutting out the member in the form of a disk by punching from the honeycomb structural body formed using the functional substrate produced by the above method, a method of forming to a spiral form a single faced corrugated fiberboard made using the functional substrate, and other methods.

Since the honeycomb structural body is high in opening ratio and is superior in gas permeability and additionally has a large surface area, the heating regeneration type organic rotor member of the present invention can function effectively as a rotor member having a adsorption performance of large capacity. Further, there are the following problems in the conventional inorganic type rotor members: (1) They are hard and brittle like pottery, and hence very weak against shock and readily broken; (2) Since high-temperature heat treatment such as firing is carried out for the removal or diminishment of organic components, there are possibilities of deterioration in adsorption characteristics of moisture adsorbents or adsorbents or restrictions in selection of raw materials; (3) Fixation strength for moisture adsorbents or adsorbents are insufficient in the case of using only inorganic materials, and exfoliation of them to some extent cannot be avoided; (4) It is difficult to control thickness of the substrate constituting the rotor members or to make thin the substrate, and it is difficult to control and decrease the pressure loss of the rotor members; and (5) Since the method of production is like production of ceramics, change of volume is apt to occur in rotor members at the time of high-temperature heat treatments such as firing to cause breakage or reduction in accuracy of size, resulting in reduction of yield, and thus they become expensive. On the other hand, these problems can be solved in the heating regeneration type organic rotor member of the present invention produced by the above-mentioned methods.

DESCRIPTION OF PREFERRED EMBODIMENTS

The present invention will be explained by the following examples, which should not be construed as limiting the invention in any manner.

EXAMPLE 1

[Preparation of Aqueous Dispersion of Fiber Substrate]

100 Parts by weight of polyester fibers (fineness: 0.5 denier, fiber length: 5 mm) and 60 parts by weight of core-sheath type heat fusible polyester fibers (fineness: 2 deniers, fiber length: 5 mm) as organic fibers were added to water and mixed to obtain an aqueous dispersion of 0.3% by weight of fiber substrate.

[Preparation of Aqueous Dispersion of Moisture Adsorbent and Active Carbon]

100 Parts by weight of powdered zeolite (molecular sieve 4A) and 100 parts by weight of powdered silica gel as moisture adsorbents and 200 parts by weight of powdered active carbon as active carbon were added to water and mixed, followed by adding suitable amounts of polyaluminum chloride and cationic polyacrylamide as agglomerating agents to prepare an aqueous dispersion of 0.3% by weight of the moisture adsorbent and the active carbon.

[Production of Functional Substrate]

The aqueous dispersion of the fiber substrate and the aqueous dispersion of the moisture adsorbent and the active carbon were mixed so as to give 150 parts by weight of the moisture adsorbent and the active carbon based on 100 parts by weight of the fiber substrate, thereby to prepare a slurry of 0.3% by weight. Then, a web of 100 g/m$^2$ in basis weight was made from the slurry using a cylinder paper machine and subjected to a pressing and heating treatment by a cylinder drier to produce a functional substrate.

[Production of Heating Regeneration Type Organic Rotor Member]

A single faced corrugated fiberboard of 2.5 mm in pitch and 1.5 mm in height was made using the functional substrate as both the corrugating medium and the liner in accordance with JIS-Z-1516-1995 "corrugated fiberboard for outer packaging". The thus obtained single faced corrugated fiberboard was formed into spiral form to produce a honeycomb structural body of 40 mm in inner diameter and 220 mm in outer diameter. As an adhesive in the formation of the honeycomb structural body, a styrene-acrylic resin was used. A honeycomb structural body of 20 mm in thickness was cut out from the above honeycomb structural body to obtain a heating regeneration type organic rotor member of Example 1.

EXAMPLE 2

[Preparation of Aqueous Dispersion of Fiber Substrate]

100 Parts by weight of vinyl chloride-acrylonitrile copolymer fibers (fineness: 1.5 denier, fiber length: 5 mm) and 60 parts by weight of core-sheath type heat fusible polyester fibers (fineness: 2 deniers, fiber length: 5 mm) as organic fibers were added to water and mixed to obtain an aqueous dispersion of 0.3% by weight of fiber substrate.

[Preparation of Aqueous Dispersion of Moisture Adsorbent and Active Carbon]

100 Parts by weight of powdered zeolite (molecular sieve 4A) and 100 parts by weight of powdered allophane as moisture adsorbents and 200 parts by weight of powdered active carbon as active carbon were added to water and mixed, followed by adding suitable amounts of polyaluminum chloride and cationic polyacrylamide as agglomerating agents to prepare an aqueous dispersion of 0.3% by weight of the moisture adsorbent and the active carbon.

[Production of Functional Substrate and Heating Regeneration Type Organic Rotor Member]

The aqueous dispersion of the fiber substrate and the aqueous dispersion of the moisture adsorbent and the active carbon were mixed so as to give 150 parts by weight of the moisture adsorbent and the active carbon based on 100 parts by weight of the fiber substrate, thereby to prepare a slurry of 0.3% by weight. Then, a web of 100 g/m$^2$ in basis weight was made from the slurry using a cylinder paper machine and subjected to a pressing and heating treatment by a cylinder drier to produce a functional substrate. A heating regeneration type organic rotor member of Example 2 was produced in the same manner as in Example 1 using the resulting functional substrate as both the corrugating medium and the liner.

EXAMPLE 3

[Preparation of Aqueous Dispersion of Fiber Substrate]

100 Parts by weight of wholly aromatic polyamide fibers (fineness: 2 deniers, fiber length: 5 mm), 40 parts by weight of core-sheath type heat fusible polyester fibers (fineness: 2 deniers, fiber length: 5 mm) and 20 parts by weight of soft wood bleached kraft pulp (unbeaten) as organic fibers were added to water and mixed to obtain an aqueous dispersion of 0.3% by weight of fiber substrate.

[Preparation of Aqueous Dispersion of Moisture Adsorbent and Active Carbon]

100 Parts by weight of powdered zeolite (molecular sieve 4A) and 100 parts by weight of powdered sepiolite as moisture adsorbents and 200 parts by weight of powdered active carbon as active carbon were added to water and mixed, followed by adding suitable amounts of polyaluminum chloride and cationic polyacrylamide as agglomerating agents to prepare an aqueous dispersion of 0.3% by weight of the moisture adsorbent and the active carbon.

[Production of Functional Substrate and Heating Regeneration Type Organic Rotor Member]

The aqueous dispersion of the fiber substrate and the aqueous dispersion of the moisture adsorbent and the active carbon were mixed so as to give 150 parts by weight of the moisture adsorbent and the active carbon based on 100 parts by weight of the fiber substrate, thereby to prepare a slurry of 0.3% by weight. Then, a web of 100 g/m$^2$ in basis weight was made from the slurry using a cylinder paper machine and subjected to a pressing and heating treatment by a cylinder drier to produce a functional substrate. Using the resulting functional substrate as both the corrugating medium and the liner, a heating regeneration type organic rotor member of Example 3 was produced in the same manner as in Example 1.

EXAMPLE 4

[Preparation of Aqueous Dispersion of Fiber Substrate]

100 Parts by weight of wholly aromatic polyester fibers (fineness: 2.5 deniers, fiber length: 6 mm), 40 parts by weight of core-sheath type heat fusible polyester fibers (fineness: 2 deniers, fiber length: 5 mm) and 20 parts by weight of soft wood bleached kraft pulp (unbeaten) as organic fibers were added to water and mixed to obtain an aqueous dispersion of 0.3% by weight of fiber substrate.

[Preparation of Aqueous Dispersion of Moisture Adsorbent and Active Carbon]

70 Parts by weight of powdered zeolite (molecular sieve 4A), 70 parts by weight of powdered silica gel and 70 parts by weight of powdered allophane as moisture adsorbents and 200 parts by weight of powdered active carbon as active carbon were added to water and mixed, followed by adding suitable amounts of polyaluminum chloride and cationic polyacrylamide as agglomerating agents to prepare an aqueous dispersion of 0.3% by weight of the moisture adsorbent and the active carbon.

[Production of Functional Substrate and Heating Regeneration Type Organic Rotor Member]

The aqueous dispersion of the fiber substrate and the aqueous dispersion of the moisture adsorbent and the active carbon were mixed so as to give 150 parts by weight of the moisture adsorbent and the active carbon based on 100 parts by weight of the fiber substrate, thereby to prepare a slurry of 0.3% by weight. Then, a web of 100 g/m$^2$ in basis weight was made from the slurry using a cylinder paper machine and subjected to a pressing and heating treatment by a cylinder drier to produce a functional substrate. Using the resulting functional substrate as both the corrugating medium and the liner, a heating regeneration type organic rotor member of Example 4 was produced in the same manner as in Example 1.

EXAMPLE 5

[Preparation of Aqueous Dispersion of Fiber Substrate]

100 Parts by weight of phenolic resin fibers (fiber diameter: 14 $\mu$m, fiber length: 6 mm), 40 parts by weight of core-sheath type heat fusible polyester fibers (fineness: 2 deniers, fiber length: 5 mm) and 20 parts by weight of polyvinyl alcohol fibers (fineness: 1 denier, fiber length: 3 mm) as organic fibers were added to water and mixed to prepare an aqueous dispersion of 0.3% by weight of fiber substrate.

[Preparation of Aqueous Dispersion of Moisture Adsorbent and Active Carbon]

70 Parts by weight of powdered zeolite (molecular sieve 4A), 70 parts by weight of powdered silica gel and 70 parts by weight of powdered allophane as moisture adsorbents and 200 parts by weight of powdered active carbon as active carbon were added to water and mixed, followed by adding suitable amounts of polyaluminum chloride and cationic polyacrylamide as agglomerating agents to prepare an aqueous dispersion of 0.3% by weight of the moisture adsorbent and the active carbon.

[Production of Functional Substrate and Heating Regeneration Type Organic Rotor Member]

The aqueous dispersion of the fiber substrate and the aqueous dispersion of the moisture adsorbent and the active carbon were mixed so as to give 150 parts by weight of the moisture adsorbent and the active carbon based on 100 parts by weight of the fiber substrate, thereby to prepare a slurry of 0.3% by weight. Then, a web of 100 g/m$^2$ in basis weight was made from the slurry using a cylinder paper machine and subjected to a pressing and heating treatment by a cylinder drier to produce a functional substrate. A heating regeneration type organic rotor member of Example 5 was produced in the same manner as in Example 1 using the resulting functional substrate as both the corrugating medium and the liner.

EXAMPLE 6

[Preparation of Aqueous Dispersion of Fiber Substrate]

100 Parts by weight of polyester fibers (fineness: 0.5 denier, fiber length: 5 mm) and 30 parts by weight of core-sheath type heat fusible polyester fibers (fineness: 2 deniers, fiber length: 5 mm) as organic fibers were added to water and mixed to obtain an aqueous dispersion of 0.3% by weight of fiber substrate.

[Preparation of Aqueous Dispersion of Agglomeration Composite]

70 Parts by weight of powdered zeolite (molecular sieve 4A), 70 parts by weight of powdered silica gel and 70 parts by weight of powdered allophane as moisture adsorbents, 200 parts by weight of powdered active carbon as active carbon, and 50 parts by weight of microfibrillated cellulose fibers (freeness: 350 seconds) as fibrillated organic fibers were added to water and mixed, followed by adding suitable amounts of polyaluminum chloride and cationic polyacrylamide as agglomerating agents to prepare an aqueous dispersion of 0.3% by weight of an agglomeration composite.

[Production of Functional Substrate and Heating Regeneration Type Organic Rotor Member]

The aqueous dispersion of the fiber substrate and the aqueous dispersion of the agglomeration composite were mixed so as to give 150 parts by weight of the agglomeration composite based on 100 parts by weight of the fiber substrate, thereby to prepare a slurry of 0.3% by weight. Then, a web of 110 g/m$^2$ in basis weight was made from the slurry using a cylinder paper machine and subjected to a pressing and heating treatment by a cylinder drier to produce a functional substrate. A heating regeneration type organic rotor member of Example 6 was produced in the same manner as in Example 1 using the resulting functional substrate as both the corrugating medium and the liner.

EXAMPLE 7

[Preparation of Aqueous Dispersion of Fiber Substrate]

100 Parts by weight of wholly aromatic polyamide fibers (fineness: 2 deniers, fiber length: 5 mm), 100 parts by weight of phenolic resin fibers (fiber diameter: 14 $\mu$m, fiber length: 5 mm) and 60 parts by weight of core-sheath type heat fusible polyester fibers (fineness: 2 deniers, fiber length: 5 mm) as organic fibers were added to water and mixed to obtain an aqueous dispersion of 0.3% by weight of fiber substrate.

[Preparation of Aqueous Dispersion of Agglomeration Composite]

70 Parts by weight of powdered zeolite (molecular sieve 4A), 70 parts by weight of powdered silica gel and 70 parts by weight of powdered allophane as moisture adsorbents, 200 parts by weight of powdered active carbon as active carbon, and 50 parts by weight of microfibrillated polyethylene fibers (freeness: 35 seconds) as fibrillated organic fibers were added to water and mixed, followed by adding suitable amounts of polyaluminum chloride and cationic polyacrylamide as agglomerating agents to prepare an aqueous dispersion of 0.3% by weight of an agglomeration composite.

[Production of Functional Substrate and Heating Regeneration Type Organic Rotor Member]

The aqueous dispersion of the fiber substrate and the aqueous dispersion of the agglomeration composite were mixed so as to give 150 parts by weight of the agglomeration composite based on 100 parts by weight of the fiber substrate, thereby to prepare a slurry of 0.3% by weight. Then, a web of 110 g/m$^2$ in basis weight was made from the slurry using a cylinder paper machine and subjected to a pressing and heating treatment by a cylinder drier to produce a functional substrate. A heating regeneration type organic rotor member of Example 7 was produced in the same manner as in Example 1 using the resulting functional substrate as both the corrugating medium and the liner.

EXAMPLE 8

[Preparation of Aqueous Dispersion of Fiber Substrate]

100 Parts by weight of polyester fibers (fineness: 0.5 denier, fiber length: 5 mm) and 100 parts by weight of core-sheath type heat fusible polyester fibers (fineness: 2 deniers, fiber length: 5 mm) as organic fibers, and 70 parts by weight of glass fibers (fiber diameter: 6 $\mu$m, fiber length: 6 mm) as inorganic fibers were added to water and mixed to prepare an aqueous dispersion of 0.3% by weight of fiber substrate.

[Preparation of Aqueous Dispersion of Moisture Adsorbent and Active Carbon]

70 Parts by weight of powdered zeolite (molecular sieve 4A), 70 parts by weight of powdered silica gel and 70 parts by weight of powdered allophane as moisture adsorbents and 200 parts by weight of powdered active carbon as active carbon were added to water and mixed, followed by adding suitable amounts of polyaluminum chloride and cationic polyacrylamide as agglomerating agents to prepare an aqueous dispersion of 0.3% by weight of the moisture adsorbent and the active carbon.

[Production of Functional Substrate and Heating Regeneration Type Organic Rotor Member]

The aqueous dispersion of the fiber substrate and the aqueous dispersion of the moisture adsorbent and the active carbon were mixed so as to give 150 parts by weight of the moisture adsorbent and the active carbon based on 100 parts by weight of the fiber substrate, thereby to prepare a slurry of 0.3% by weight. Then, a web of 100 g/m$^2$ in basis weight was made from the slurry using a cylinder paper machine and subjected to a pressing and heating treatment by a cylinder drier to produce a functional substrate. A heating regeneration type organic rotor member of Example 8 was produced in the same manner as in Example 1 using the resulting functional substrate as both the corrugating medium and the liner.

EXAMPLE 9

[Preparation of Aqueous Dispersion of Fiber Substrate]

100 Parts by weight of wholly aromatic polyamide fibers (fineness: 2 deniers, fiber length: 5 mm) and 100 parts by weight of core-sheath type heat fusible polyester fibers (fineness: 2 deniers, fiber length: 5 mm) as organic fibers, and 70 parts by weight of rock wool as inorganic fibers were added to water and mixed to prepare an aqueous dispersion of 0.3% by weight of fiber substrate.

[Preparation of Aqueous Dispersion of Moisture Adsorbent and Active Carbon]

70 Parts by weight of powdered zeolite (molecular sieve 4A), 70 parts by weight of powdered silica gel and 70 parts by weight of powdered allophane as moisture adsorbents and 200 parts by weight of powdered active carbon as active carbon were added to water and mixed, followed by adding suitable amounts of polyaluminum chloride and cationic polyacrylamide as agglomerating agents to prepare an aqueous dispersion of 0.3% by weight of the moisture adsorbent and the active carbon.

[Production of Functional Substrate and Heating Regeneration Type Organic Rotor Member]

The aqueous dispersion of the fiber substrate and the aqueous dispersion of the moisture adsorbent and the active carbon were mixed so as to give 150 parts by weight of the moisture adsorbent and the active carbon based on 100 parts by weight of the fiber substrate, thereby to prepare a slurry of 0.3% by weight. Then, a web of 100 g/m$^2$ in basis weight was made from the slurry using a cylinder paper machine and subjected to a pressing and heating treatment by a cylinder drier to produce a functional substrate. A heating regeneration type organic rotor member of Example 9 was produced in the same manner as in Example 1 using the resulting functional substrate as both the corrugating medium and the liner.

EXAMPLE 10

[Preparation of Aqueous Dispersion of Fiber Substrate]

100 Parts by weight of vinyl chloride-acrylonitrile copolymer fibers (fineness: 1.5 denier, fiber length: 5 mm) and 100 parts by weight of core-sheath type heat fusible polyester fibers (fineness: 2 deniers, fiber length: 5 mm) as organic fibers, and 70 parts by weight of glass fibers (fiber diameter: 6 $\mu$m, fiber length: 6 mm) as inorganic fibers were added to water and mixed to prepare an aqueous dispersion of 0.3% by weight of fiber substrate.

[Preparation of Aqueous Dispersion of Agglomeration Composite]

70 Parts by weight of powdered zeolite (molecular sieve 4A), 70 parts by weight of powdered silica gel and 70 parts by weight of powdered allophane as moisture adsorbents, 200 parts by weight of powdered active carbon as active carbon, and 50 parts by weight of pulp-like wholly aromatic polyamide fibers (freeness: 35 seconds) as fibrillated organic fibers were added to water and mixed, followed by adding suitable amounts of polyaluminum chloride and cationic polyacrylamide as agglomerating agents to prepare an aqueous dispersion of 0.3% by weight of an agglomeration composite.

[Production of Functional Substrate and Heating Regeneration Type Organic Rotor Member]

The aqueous dispersion of the fiber substrate and the aqueous dispersion of the agglomeration composite were mixed so as to give 150 parts by weight of the agglomeration composite based on 100 parts by weight of the fiber substrate, thereby to prepare a slurry of 0.3% by weight. Then, a web of 110 g/m$^2$ in basis weight was made from the slurry using a cylinder paper machine and subjected to a pressing and heating treatment by a cylinder drier to produce a functional substrate. A heating regeneration type organic rotor member of Example 10 was produced in the same manner as in Example 1 using the resulting functional substrate as both the corrugating medium and the liner.

EXAMPLE 11

[Preparation of Aqueous Dispersion of Fiber Substrate]

100 Parts by weight of wholly aromatic polyamide fibers (fineness: 2 deniers, fiber length: 5 mm) and 100 parts by weight of core-sheath type heat fusible polyester fibers (fineness: 2 deniers, fiber length: 5 mm) as organic fibers, and 70 parts by weight of glass fibers (fiber diameter: 6 $\mu$m, fiber length: 6 mm) as inorganic fibers were added to water and mixed to prepare an aqueous dispersion of 0.3% by weight of fiber substrate.

[Preparation of Aqueous Dispersion of Agglomeration Composite]

70 Parts by weight of powdered zeolite (molecular sieve 4A), 70 parts by weight of powdered silica gel and 70 parts by weight of powdered allophane as moisture adsorbents, 200 parts by weight of powdered active carbon as active carbon, and 50 parts by weight of highly beaten soft wood bleached kraft pulp (freeness: 100 seconds) as fibrillated organic fibers were added to water and mixed, followed by adding suitable amounts of polyaluminum chloride and cationic polyacrylamide as agglomerating agents to prepare an aqueous dispersion of 0.3% by weight of an agglomeration composite.

[Production of Functional Substrate and Heating Regeneration Type Organic Rotor Member]

The aqueous dispersion of the fiber substrate and the aqueous dispersion of the agglomeration composite were mixed so as to give 150 parts by weight of the agglomeration composite based on 100 parts by weight of the fiber substrate, thereby to prepare a slurry of 0.3% by weight. Then, a web of 110 g/m$^2$ in basis weight was made from the slurry using a cylinder paper machine and subjected to a pressing and heating treatment by a cylinder drier to produce a functional substrate. A heating regeneration type organic rotor member of Example 11 was produced in the same manner as in Example 1 using the resulting functional substrate as both the corrugating medium and the liner.

EXAMPLE 12

[Production of Fiber Substrate]

A web of 40 g/m$^2$ in basis weight was made from the aqueous dispersion of the fiber substrate of Example 1 using a cylinder paper machine and subjected to a pressing and heating treatment by a cylinder drier to produce a fiber substrate.

[Preparation of Dispersion of Moisture Adsorbent and Active Carbon]

70 Parts by weight of powdered zeolite (molecular sieve 4A), 70 parts by weight of powdered silica gel and 70 parts by weight of powdered allophane as moisture adsorbents, 200 parts by weight of powdered active carbon as active carbon, and 80 parts by weight of styrene-acrylic resin as a binder component were added to water and mixed to prepare a dispersion of 20% by weight of the moisture adsorbent and the active carbon.

[Production of Functional Substrate and Heating Regeneration Type Organic Rotor Member]

The fiber substrate was impregnated with the dispersion in an amount of 70 g/m$^2$ (in terms of effective component) to carry the dispersion on the substrate by a size press, followed by drying to produce a functional substrate. A heating regeneration type organic rotor member of Example 12 was produced in the same manner as in Example 1 using the resulting functional substrate as both the corrugating medium and the liner.

EXAMPLE 13

[Production of Fiber Substrate]

A web of 30 g/m$^2$ in basis weight was made by unbinding and mixing 100 Parts by weight of polyester fibers (fineness: 3 deniers, fiber length: 38 mm), 60 parts by weight of polyester fibers (fineness: 6 deniers, fiber length: 51 mm) and 40 parts by weight of rayon fibers (fineness: 3 deniers, fiber length: 51 mm) as organic fibers. Then, the web was impregnated with 10 g/m$^2$ of acrylic resin to carry the resin on the web, followed by drying to produce a fiber substrate of 40 g/m$^2$ in basis weight.

[Preparation of Dispersion of Moisture Adsorbent and Active Carbon]

70 Parts by weight of powdered zeolite (molecular sieve 4A), 70 parts by weight of powdered silica gel and 70 parts by weight of powdered allophane as moisture adsorbents, 200 parts by weight of powdered active carbon as active carbon, and 80 parts by weight of styrene-acrylic resin as a binder component were added to water and mixed to prepare a dispersion of 20% by weight of the moisture adsorbent and the active carbon.

[Production of Functional Substrate and Heating Regeneration Type Organic Rotor Member]

The fiber substrate was impregnated with the dispersion in an amount of 70 g/m$^2$ (in terms of effective component) to carry the dispersion on the substrate by a size press, followed by drying to produce a functional substrate. A heating regeneration type organic rotor member of Example 13 was produced in the same manner as in Example 1 using the resulting functional substrate as both the corrugating medium and the liner.

COMPARATIVE EXAMPLE 1

[Production of Substrate]

100 Parts by weight of silica-alumina ceramics fibers, 10 parts by weight of glass fibers (fiber diameter: 6 $\mu$m, fiber length: 6 mm), 20 parts by weight of soft wood bleached kraft pulp (unbeaten), 20 parts by weight of polyvinyl alcohol fibers (fineness: 1 denier, fiber length 3 mm), and 50 parts by weight of a powdered ceramic binder were added to water and mixed to prepare a slurry of 0.3% by weight. A web of 65 g/m$^2$ in basis weight was made from the resulting slurry using a cylinder paper machine and subjected to a pressing and heating treatment by a cylinder drier to produce a substrate.

[Production of Rotor Member]

A single faced corrugated fiberboard of 2.5 mm in pitch and 1.5 mm in height was made using the resulting substrate as both the corrugating medium and the liner in accordance with JIS-Z-1516-1995 "corrugated fiberboard for outer packaging". The thus obtained single faced corrugated fiberboard was formed into spiral form to produce a honeycomb structural body of 40 mm in inner diameter and 220 mm in outer diameter. A styrene-acrylic resin was used as an adhesive at the time of the formation. A honeycomb structural body of 20 mm in thickness was cut out from the honeycomb structural body, and the honeycomb structural body cut out was fired at a high temperature to remove the organic components (soft wood bleached kraft pulp, polyvinyl alcohol fibers, styrene-acrylic resin) to produce an inorganic honeycomb structural body. This inorganic honeycomb structural body was impregnated with 70 g/m$^2$ (in terms of effective components) of a dispersion of 20% by weight prepared by mixing 70 parts by weight of powdered zeolite (molecular sieve 4A), 70 parts by weight of powdered silica gel and 70 parts by weight of powdered allophane as moisture adsorbents, 200 parts by weight of powdered active carbon as active carbon, and 80 parts by weight of colloidal silica as a binder component, and this honeycomb structural body was dried at a high temperature to produce a rotor member of Comparative Example 1.

COMPARATIVE EXAMPLE 2

[Preparation of Aqueous Dispersion of Fibers]

100 Parts by weight of polyester fibers (fineness: 0.5 denier, fiber length: 5 mm) and 60 parts by weight of core-sheath type heat fusible polyester fibers (fineness: 2 deniers, fiber length: 5 mm) were added to water and mixed to prepare an aqueous dispersion of 0.3% by weight of fibers.

[Preparation of Aqueous Dispersion of Moisture Adsorbent]

100 Parts by weight of powdered zeolite (molecular sieve 4A) and 100 parts by weight of powdered silica gel as moisture adsorbents were added to water and mixed, followed by adding suitable amounts of polyaluminum chloride and cationic polyacrylamide as agglomerating agents to prepare an aqueous dispersion of 0.3% by weight of moisture adsorbent.

[Production of Substrate and Rotor Member]

The aqueous dispersion of the fibers and the aqueous dispersion of the moisture adsorbent were mixed so as to give 75 parts by weight of the moisture adsorbent based on 100 parts by weight of the fibers, thereby to prepare a slurry of 0.3% by weight. Then, a web of 70 g/m$^2$ in basis weight was made from the slurry using a cylinder paper machine and subjected to a pressing and heating treatment by a cylinder drier to produce a substrate. A rotor member of Comparative Example 2 was produced in the same manner as in Example 1 using the resulting substrate as both the corrugating medium and the liner.

COMPARATIVE EXAMPLE 3

[Preparation of Aqueous Dispersion of Fibers]

100 Parts by weight of polyester fibers (fineness: 0.5 denier, fiber length: 5 mm) and 60 parts by weight of core-sheath type heat fusible polyester fibers (fineness: 2 deniers, fiber length: 5 mm) were added to water and mixed to prepare an aqueous dispersion of 0.3% by weight of fibers.

[Preparation of Aqueous Dispersion of Active Carbon]

100 Parts by weight of powdered active carbon as active carbon was added to water, followed by adding suitable amounts of polyaluminum chloride and cationic polyacrylamide as agglomerating agents to prepare an aqueous dispersion of 0.3% by weight of active carbon.

[Production of Substrate and Rotor Member]

The aqueous dispersion of the fibers and the aqueous dispersion of the active carbon were mixed so as to give 75 parts by weight of the active carbon based on 100 parts by weight of the fibers, thereby to prepare a slurry of 0.3% by weight. Then, a web of 70 g/m$^2$ in basis weight was made from the slurry using a cylinder paper machine and subjected to a pressing and heating treatment by a cylinder drier to produce a substrate. A rotor member of Comparative Example 3 was produced in the same manner as in Example 1 using the resulting substrate as both the corrugating medium and the liner.

The heating regeneration type organic rotor members of Examples 1–13 and rotor members of Comparative Examples 1–3 were evaluated in accordance with the following performance tests.

[Dehumidification Performance]

Figure 2:
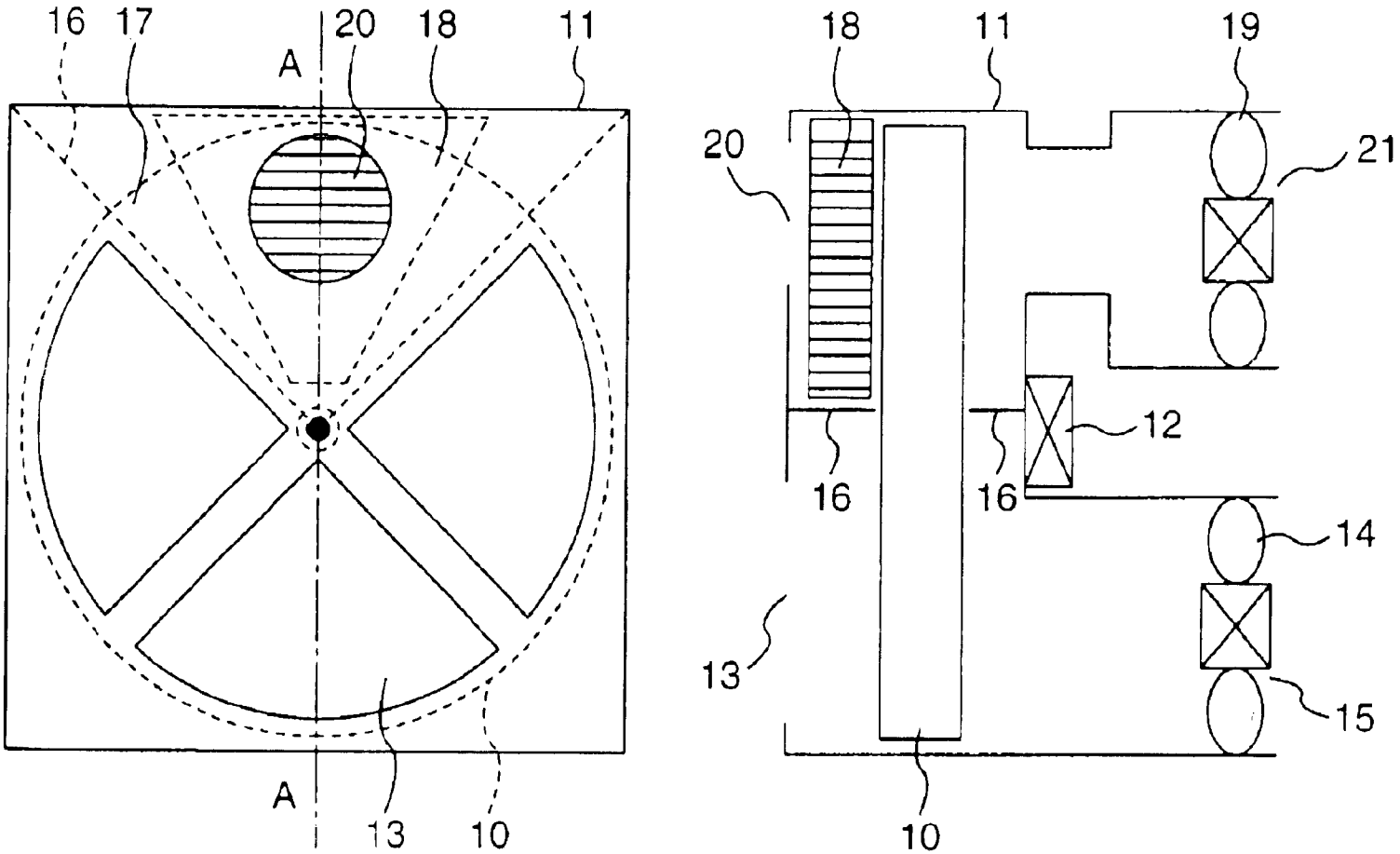
FIG. 2 is a front view of the evaluation apparatus used in the examples and a sectional view of the apparatus taken on the line A—A.

An apparatus used for evaluation of dehumidification performance is schematically shown in FIG. 2. The evaluation apparatus comprises a casing 11 in which is disposed a rotor member 10 of the examples and the comparative examples, a motor 12 which rotates the rotor member, an intake vent 13 which takes into the casing the air to be treated, a fan motor 14 which is an air sending means, an exhaust vent 15 which exhausts the treated air, a heating regeneration part 17 partitioned from the path of the air to be treated by enclosing a part of the casing with a partition plate 16, a heating device 18 provided in the heating regeneration part, a fan motor 19 for ventilation, and an intake vent 20 of the heating regeneration part and an exhaust vent 21 of the heating regeneration part which are for ventilation. This apparatus is disposed in a thermo-hygrostat chamber (16 $m^3$), a duct is connected to the exhaust vent 21 of the heating regeneration part to allow it to lead to a heat exchanger so that the air containing moisture which is discharged from the exhaust vent 21 of the heating regeneration part can be condensed and collected as water drops. The temperature and humidity conditions in the thermo-hygrostat chamber are set at the two standards of 23° C./50% RH and 23° C./80% RH, and amount (kg) of the water drops collected after operation of the apparatus for 24 hours is used as an indicator for dehumidification performance.

[Deodorization Performance]

The evaluation apparatus of FIG. 2 is disposed in a container of 1 $m^3$, and a duct is connected to each of the intake vent 20 of the heating regeneration part and the exhaust vent 21 of the heating regeneration part. The duct is allowed to communicate with outside of the container so that air can be taken in from the outside of the container and discharged to the outside of the container, thereby to ventilate the heating regeneration part 17. The container (including the ducts) is disposed in a thermo-hygrostat chamber (16 $m^3$) so that temperature and humidity in the container can be adjusted. Acetaldehyde was used as a test gas on the deodorization performance. Acetaldehyde (concentration: 100 ppm) was poured into the container, and then the evaluation apparatus was operated and acetaldehyde concentration (C1: ppm) in the container after operation for 20 minutes was measured. Subsequently, the same procedure was repeated twice, and the acetaldehyde concentrations (C2 and C3: ppm) were measured. The resulting concentrations C1–C3 were taken as indicator for deodorization performance. The temperature and humidity conditions in the thermo-hygrostat chamber were the two standards of 23° C./50% RH and 23° C./80% RH.

[Heat Resistance]

The rotor member of the examples and the comparative examples was left to stand for about 1 month (700 hours) in a hot-air drier of 150° C. After lapse of 1 month, the rotor member was visually observed, and when there were seen neither deformations nor damages, the heat resistance was graded as "superior", when there were no practical problems, but there was seen a slight change (such as waviness), the heat resistance was graded as "medium", and when there were practically serious deformations (such as warpage) or damages, the heat resistance was graded as "inferior".

[Flame Retardance]

The substrate constituting the rotor member of the examples and the comparative examples was evaluated on flame retardance in accordance with UL94VTM "vertical flame test of thin materials". However, as to Comparative Example 1, the substrate which was subjected to firing treatment and then impregnated with given amounts of the moisture adsorbent, the active carbon and the binder component to carry them was used as a test sample. Criterion of the flame retardance comprises three grades, and the grade of flame retardance is higher in the order of 94VTM-2, 94VTM-1, and 94VTM-0.

[Strength]

The rotor member of the examples and the comparative examples was subjected to a drop test which comprises dropping the rotor member on a plywood from a height of 1 m, thereby measuring the strength of the rotor member. The dropping direction was vertical to the cylindrical section of the rotor member, and the number of test was 10 samples. The rotor member after dropped was visually observed, and the number of the rotor members which suffered damages such as breakage, chipping and cracking was taken as indicator for strength.

[Exfoliation]

The rotor member of the examples and the comparative examples was subjected to evaluation on the degree of exfoliation of moisture adsorbent and active carbon. An acrylic resin plate having an adhesive tape applied thereto was disposed at the exhaust vent 15 of the evaluation apparatus of FIG. 2, and the apparatus was operated for 24 hours in the thermo-hygrostat chamber (16 $m^3$) of a temperature of 23° C. and a relative humidity of 50% (without ventilation of the heating regeneration part 17). After 24 hours, the surface of the adhesive tape was visually observed, and when adhesion of the moisture adsorbent and the active carbon to the surface of the adhesive tape was not found, the degree of exfoliation was graded as "superior", when slight adhesion of the moisture adsorbent and the active carbon was found, the degree of exfoliation was graded as "medium", and when adhesion of the moisture adsorbent and the active carbon was readily found, the degree of exfoliation was graded as "inferior".

Results of the above tests are shown in Tables 1 and 2.

TABLE 1

| | | Example | | | | | | | |
|---|---|---|---|---|---|---|---|---|---|
| | | 1 | 2 | 3 | 4 | 5 | 6 | 7 | 8 |
| Dehumidification performance (kg) | | | | | | | | | |
| 50% RH | | 3.56 | 3.91 | 3.55 | 3.65 | 3.58 | 4.00 | 3.92 | 3.55 |
| 80% RH | | 4.84 | 5.15 | 4.52 | 5.22 | 5.15 | 5.71 | 5.61 | 5.08 |
| Deodorization performance (ppm) | | | | | | | | | |
| 50% RH | C1 | 10 | 9 | 10 | 9 | 11 | 5 | 6 | 10 |
| | C2 | 9 | 11 | 10 | 10 | 10 | 5 | 5 | 10 |
| | C3 | 10 | 9 | 10 | 10 | 10 | 5 | 5 | 10 |

TABLE 1-continued

| | | Example | | | | | | | |
|---|---|---|---|---|---|---|---|---|---|
| | | 1 | 2 | 3 | 4 | 5 | 6 | 7 | 8 |
| 80% RH | C1 | 15 | 15 | 16 | 14 | 14 | 10 | 10 | 16 |
| | C2 | 15 | 12 | 14 | 12 | 13 | 9 | 8 | 14 |
| | C3 | 16 | 13 | 15 | 13 | 13 | 8 | 8 | 13 |
| Heat resistance | | Medium | Medium | Superior | Superior | Superior | Medium | Superior | Superior |
| Flame retardance (UL94VTM) | | Burnt | Burnt | 0 | 0 | 0 | Burnt | 0 | 3 |
| Strength (Number) | | 0 | 0 | 0 | 0 | 0 | 0 | 0 | 0 |
| Exfoliation | | Medium | Medium | Medium | Medium | Medium | Superior | Superior | Medium |

TABLE 2

| | | Example | | | | | Comparative Example | | |
|---|---|---|---|---|---|---|---|---|---|
| | | 9 | 10 | 11 | 12 | 13 | 1 | 2 | 3 |
| Dehumidification performance (kg) | | | | | | | | | |
| 50% RH | | 3.60 | 3.84 | 3.95 | 3.42 | 3.45 | 3.26 | 2.31 | 0.71 |
| 80% RH | | 5.09 | 5.62 | 5.68 | 4.95 | 4.96 | 4.85 | 3.05 | 1.13 |
| Deodorization performance (ppm) | | | | | | | | | |
| 50% RH | C1 | 11 | 5 | 5 | 13 | 13 | 15 | 62 | 40 |
| | C2 | 10 | 5 | 6 | 13 | 11 | 15 | 62 | 42 |
| | C3 | 10 | 5 | 6 | 12 | 12 | 16 | 61 | 42 |
| 80% RH | C1 | 15 | 11 | 12 | 18 | 16 | 22 | 70 | 50 |
| | C2 | 14 | 8 | 9 | 16 | 17 | 24 | 72 | 55 |
| | C3 | 14 | 8 | 8 | 16 | 17 | 22 | 73 | 55 |
| Heat resistance | | Superior | Superior | Superior | Medium | Medium | Superior | Medium | Medium |
| Flame retardance (UL94VTM) | | 0 | 3 | 0 | Burnt | Burnt | 0 | Burnt | Burnt |
| Strength (Number) | | 0 | 0 | 0 | 0 | 0 | 10 | 0 | 0 |
| Exfoliation | | Medium | Superior | Superior | Medium | Medium | Inferior | Medium | Medium |

In comparison with the conventional inorganic rotor blade (Comparative Example 1) produced in the manner of production of ceramics, the heating regeneration type organic rotor members of the examples were high in strength and excellent in shock resistance and fixation strength for moisture adsorbent and active carbon. By using heat resistant organic fibers or inorganic fibers (Examples 3–5, 7–11), heat resistance and flame retardance were markedly improved, and heating regeneration type organic rotor members can be obtained which can sufficiently stand the use by regeneration in a high-temperature atmosphere which is employed for inorganic rotor members.

Furthermore, the heating regeneration type organic rotor members of the examples which used moisture adsorbent and active carbon in combination were excellent in both characteristics of dehumidification and deodorization, and thus can be effectively utilized as dehumidification and deodorization rotor members (Examples 1–13 vs. Comparative Examples 1 and 2). The dehumidification amount of the heating regeneration type organic rotor member of Example 1 (relative humidity 50% : 3.56 kg; relative humidity 80% : 4.84 kg) was larger by about 15% than the sum of the dehumidification amounts of the rotor members of Comparative Examples 2 and 3 which used the moisture adsorbent and the active carbon singly (relative humidity 50% : 3.02 kg; relative humidity 80% : 4.18 kg), and the use of active carbon in combination exhibited not only the effect of adding new functions such as deodorization, but also the unexpected effect of improvement of dehumidification performance. On the other hand, the use of moisture adsorbent in combination inhibited the deterioration of deodorization performance under the condition of high humidity (relative humidity 80% ) (Examples 1–13 vs. Comparative Example 3), and it can be seen that adsorption characteristics of both the moisture adsorbent and the active carbon were synergistically enhanced by using them in combination.

Moreover, by forming an agglomeration composite of moisture adsorbent, active carbon and fibrillated organic fibers (Examples 6–7 and 10–11), not only fixation strength for moisture adsorbent and active carbon can be further improved, but also there was obtained an unexpected effect of further enhancing both the characteristics of dehumidification and deodorization.

As explained above, the heating regeneration type organic rotor member of the present invention comprises a honeycomb structural body capable of being continuously regenerated by heating upon rotational driving and remarkably improved in mechanical strength by using a fiber substrate essentially composed of organic fibers, and can efficiently adsorb and remove moisture and odor components in the air by the action of moisture adsorbent and active carbon carried on the fiber substrate. Therefore, the heating regeneration type organic rotor member of the present invention can be effectively utilized as dehumidification unit and deodorization unit of various air conditioning equipment such as air cleaners and air conditioner.

What is claimed is:

1. A heating regeneration type organic rotor member continuously regenerated by heating with rotational driving which is produced by forming a functional substrate into a honeycomb structural body, the functional substrate comprising a fiber substrate containing organic fibers, in an amount of not less than 50% based on the weight of the fiber substrate, as an essential component and carrying thereon a moisture adsorbent and an active carbon, wherein the amount of the active carbon is not less than 10 parts by weight based on 100 parts by weight of the moisture absorbent, or the amount of the moisture absorbent is not less than 10 parts by weight based on 100 parts by weight of the active carbon; and the carrying amount of the moisture absorbent and the active carbon in total is not less than 30 $g/m^2$.

2. A heating regeneration type organic rotor member according to claim 1, wherein the moisture adsorbent is at least one member selected from the group consisting of zeolite, silica gel, allophane and sepiolite.

3. A heating regeneration type organic rotor member according to claim 1, wherein the organic fibers are heat resistant organic fibers.

4. A heating regeneration type organic rotor member according to claim 3, wherein the heat resistant organic fibers are at least one member selected from the group consisting of wholly aromatic polyamide fibers, wholly aromatic polyester fibers and phenolic resin fibers.

5. A heating regeneration type organic rotor member according to claim 1, wherein the functional substrate comprises said fiber substrate carrying thereon an agglomeration composite of said moisture adsorbent, said active carbon and said organic fibers fibrillated to a freeness of not less than 30 seconds.

6. A heating regeneration type organic rotor member according to claim 1, wherein the fiber substrate contains inorganic fibers.

* * * * *